US005275891A

United States Patent [19]

Tagaya et al.

[11] Patent Number: 5,275,891

[45] Date of Patent: Jan. 4, 1994

[54] R-TM-B PERMANENT MAGNET MEMBER HAVING IMPROVED CORROSION RESISTANCE AND METHOD OF PRODUCING SAME

[75] Inventors: Atsushi Tagaya; Motoharu Shimizu, both of Kumagaya, Japan

[73] Assignee: Hitachi Metals, Ltd., Tokyo, Japan

[21] Appl. No.: 770,809

[22] Filed: Oct. 4, 1991

[30] Foreign Application Priority Data

Oct. 4, 1990 [JP] Japan ..... 2-266977
Mar. 4, 1991 [JP] Japan ..... 3-62561
Jun. 3, 1991 [JP] Japan ..... 3-131040

[51] Int. Cl.[5] ..... H01F 1/053

[52] U.S. Cl. ..... 428/632; 428/611; 428/900; 428/928; 427/436

[58] Field of Search ..... 428/900, 611, 655, 629, 428/632, 928; 427/436

[56] References Cited

U.S. PATENT DOCUMENTS 3,518,169 6/1970 Oyama ..... 205/319
4,169,022 9/1982 Ward ..... 205/319
4,696,724 9/1987 Deguchi et al. ..... 427/438
4,967,116 10/1990 Oshima ..... 313/141
4,983,262 1/1991 Verhoeven ..... 204/38.4

FOREIGN PATENT DOCUMENTS 0029257 5/1981 European Pat. Off. .
60-0054406 3/1985 Japan .
63-0110707 5/1988 Japan .
2073779 10/1981 United Kingdom .
2079319 1/1982 United Kingdom .
2101163 1/1983 United Kingdom .

*Primary Examiner*—Gregory A. Heller
*Assistant Examiner*—Valerie Ann Lund
*Attorney, Agent, or Firm*—Sughrue, Mion, Zinn, Macpeak & Seas

[57] ABSTRACT

The R-TM-B permanent magnet member having an improved corrosion resistance comprising an R-TM-B permanent magnet body provided with a nickel plating layer and then with a chromate coating layer, which may be then subjected to an immersion treatment in an alkali solution.

12 Claims, No Drawings

R-TM-B PERMANENT MAGNET MEMBER HAVING IMPROVED CORROSION RESISTANCE AND METHOD OF PRODUCING SAME

BACKGROUND OF THE INVENTION

The present invention relates to an R-TM-B permanent magnet member having an improved corrosion resistance.

Due to the recent trend of miniaturization of electric and electronic appliances having higher performance, permanent magnet members, parts of such appliances, are also demanded to have higher performance and smaller sizes. Conventionally most powerful permanent magnets are rare earth metal-cobalt (R-Co) permanent magnets, but a more powerful R-TM-B permanent magnet has been developed (U.S. Pat. No. 4,864,406). In the above R-TM-B magnet, R represents one or more rare earth metals including Y, TM represents a transition metal based on Fe or Co, part of which may be substituted by other metals or non-metals, and B represents boron.

However, since the R-TM-B permanent magnets are easily rusted, their surfaces are provided with anti-oxidizing coating layers to improve their corrosion resistance. The types of the anti-oxidizing coating layers proposed so far include a nickel plating layer, an anti-oxidizing resin coating layer, an Al ion plating layer, etc. Among them, the nickel plating layer has been paid much attention as an effective means for easily improving the corrosion resistance of the R-TM-B permanent magnets (Japanese Patent Laid-Open No. 60-54406). The nickel plating layer is more advantageous than the anti-oxidizing resin coating layer in that the former shows higher mechanical strength and smaller moisture absorption.

Nevertheless, unlike the anti-oxidizing resin coating layer, the nickel plating layer disadvantageously has pinholes. Therefore, despite its low moisture absorption, moisture permeates the nickel plating layer to a surface of the permanent magnet through pinholes of the nickel plating layer as the time elapses, causing corrosion of the permanent magnet.

To solve this problem, various attempts have been proposed: A two-layer Ni plating method, a method of coating a nickel plating layer with an anti-oxidizing resin to cover pinholes (Japanese Patent Laid-Open No. 63-110707).

However, in the above methods, the adhesion of a lower nickel plating layer to an upper nickel plating layer or to an anti-oxidizing resin coating layer, and the corrosion resistance of the upper nickel plating layer and the anti-oxidizing resin coating layer are not sufficient. Accordingly, these methods fail to provide a high corrosion resistance to the R-TM-B permanent magnet members.

In addition, the plated R-TM-B permanent magnet members are likely to be covered with a thin organic film, which prevents the R-TM-B permanent magnet members from being well adhered to substrates. Accordingly, in order to bond the R-TM-B permanent magnet members to the substrates of electric or electronic appliances strongly, it is important to improve the adhesion properties of the R-TM-B permanent magnet members.

OBJECT AND SUMMARY OF THE INVENTION

Accordingly, an object of the present invention is to provide a highly reliable, highly corrosion-resistant R-TM-B permanent magnet member.

Another object of the present invention is to provide a method of producing such an R-TM-B permanent magnet member.

A further object of the present invention is to provide a highly corrosion-resistant R-TM-B permanent magnet member with good adhesion properties.

Thus, the R-TM-B permanent magnet member having an improved corrosion resistance according to one embodiment of the present invention comprises an R-TM-B permanent magnet body having a composition, by weight, of 5–40% of R, 50–90% of TM and 0.2–8% of B, wherein R represents one or more rare earth metals including Y, TM represents a transition metal based on Fe, and B represents boron, the R-TM-B permanent magnet body being provided with a nickel plating layer and then with a chromate coating layer.

The method of producing an R-TM-B permanent magnet member having an improved corrosion resistance according to another embodiment of the present invention comprises the steps of forming a nickel plating layer on a surface of an R-TM-B permanent magnet body having a composition, by weight, of 5–40% of R, 50–90% of TM and 0.2–8% of B, wherein R represents one or more rare earth metals including Y, TM represents a transition metal based on Fe, and B represents boron, immersing the resulting Ni-plated R-TM-B permanent magnet body in an aqueous solution of chromic anhydride or dichromic acid, washing it with water and drying it, so that a chromate coating layer is formed on the nickel plating layer.

The R-TM-B permanent magnet member having improved corrosion resistance and adhesion properties according to a further embodiment of the present invention comprises an R-TM-B permanent magnet body having a composition, by weight, of 5–40% of R, 50–90% of TM and 0.2–8% of B, wherein R represents one or more rare earth metals including Y, TM represents a transition metal based on Fe, and B represents boron, the R-TM-B permanent magnet body being provided with a nickel plating layer and a chromate coating layer, and then subjected to an immersion treatment in an alkali solution.

The R-TM-B permanent magnet member having an improved corrosion resistance according to a still further embodiment of the present invention comprises an R-TM-B permanent magnet body having a composition, by weight, of 5–40% of R, 50–90% of TM and 0.2–8% of B, wherein R represents one or more rare earth metals including Y, TM represents a transition metal based on Fe, and B represents boron, said R-TM-B permanent magnet body being provided with a lower metal plating layer selected from Ni, Ni-S, Ni-P, Cu, Cr, and Sn, and an upper metal plating layer selected from Ni, Ni-S, Ni-P, Cr, Sn, and Zn, the lower and upper metal plating layers being different from each other, and the upper metal plating layer being less noble by, 100 mV or more, than the lower metal plating layer with respect to a natural potential in a 5-%-NaCl aqueous solution.

DETAILED DESCRIPTION OF THE INVENTION

In the R-TM-B permanent magnet of the present invention, when R (one or more rare earth metals including Y) is less than 5 weight %, sufficient iHc cannot be obtained, and when it exceeds 40 weight %, the Br of the R-TM-B permanent magnet decreases. Thus, the amount of R is preferably 5–40 weight %. TM is Fe which may be partially substituted with Co and/or Ni. The amount of TM is preferably 50–90% by weight. When B is less than 0.2 weight %, the $R_2Fe_{14}B$ phase, a main phase of the permanent magnet is not fully formed, resulting in low Br and iHc. On the other hand, when it exceeds 8 weight %, a phase undesirable for magnetic properties appears, resulting in low Br. The amount of B is preferably 0.2–8% by weight.

One or more of Ga, Al, Ti, V, Cr, Mn, Zr, Hf, Nb, Ta, Mo, Ge, Sb, Sn, Bi, etc. may be added to the R-TM-B permanent magnet depending upon its application. These elements are preferably 5% by weight or less.

The R-TM-B permanent magnet body of the present invention may be produced by any methods including a sintering method, a melt quenching method, etc.

The R-TM-B permanent magnet body produced in a desired shape is degreased with an organic solvent and then subjected to a pretreatment. In the pretreatment, an acidic solution is preferably used to remove a surface layer degenerated by working and to activate a surface of the R-TM-B permanent magnet body. Strong acids such as sulfuric acid, hydrochloric acid, etc. are effective for the activation, but to avoid the pretreatment from affecting the R-TM-B permanent magnet itself, it is preferable to carry out a first etching by 2–10 volume % of nitric acid and then a second etching by a mixed acid of 5–10 volume % of a peroxide such as hydrogen peroxide, and 10–30 volume % of a weak acid such as acetic acid, formic acid, etc.

Next, the nickel plating is carried out. The nickel plating can be conducted by using a Watts bath, a sulfamate bath, or an ammonate bath, and the bath is preferably a bright one because a dull plating generates an undesirable columnar crystal structure. Incidentally, the dull plating can be used for an undercoat in a multilayer plating because it has good adhesion and small stress.

One example of the composition of the Watts bath is 290 g/l of nickel sulfate, 60 g/l of nickel chloride and 40 g/l of boric acid at pH of 4.6.

One example of the composition of the sulfamate bath is 370 g/l of nickel sulfamate, 30 g/l of nickel chloride and 30 g/l of boric acid at pH of 4.0.

One example of the composition of the ammonate bath is 150 g/l of nickel sulfate, 20 g/l of ammonium chloride and 20 g/l of boric acid at pH of 5.5.

The nickel plating is carried out at a current density of 1–2 $A/dm^2$, at a temperature of 45°–60° C. for 1–3 hours. When these conditions are not met, the desired nickel plating layer cannot be formed. The resulting nickel plating layer preferably has a thickness of 5–20 μm.

After the completion of the nickel plating and washing with water, a chromate treatment is carried out by immersing the Ni-plated R-TM-B permanent magnet body in a chromic acid solution. The temperature of the chromic acid solution is preferably 20°–80° C., and the immersion time is preferably 1–10 minutes. To activate the immersion treatment, it is preferable to use an aqueous acid solution having a high acidity. Here, the important point is to use an aqueous solution of chromic acid containing no strong acid such as sulfuric acid, hydrochloric acid and nitric acid.

A chromate treatment is usually carried out in the art by using a chromic acid solution containing a small amount of a strong acid. However, if a strong acid is contained in the chromic acid solution in the chromate treatment of the present invention, the chromic acid solution is excessively activated, causing the dissolution of Ni from the nickel plating layer. This is undesirable because it lowers the adhesion of the resulting chromate coating layer to the underlying nickel plating layer. Also, when the strong acid permeates the nickel plating layer to the permanent magnet body through the pinholes of the nickel plating layer, the permanent magnet body is likely to be corroded. Therefore, the chromic acid solution used in the immersion treatment should be free from the strong acid.

In the chromic acid solution which is an aqueous solution of chromic anhydride or dichromic acid, the Cr concentration is preferably 0.01 mol/l or more, particularly 0.05–0.1 mol/l, to activate the immersion treatment.

The chromate coating layer formed by a chromate treatment is extremely thin (2–20 Å), but it shows good adhesion to the underlying nickel plating layer. Also, it is amorphous, has no pores and shows high repulsion to water. Accordingly, the underlying layer is extremely well protected from moisture. When the chromate coating layer with broken spots is brought into contact with water, $Cr^{+6}$ ions are dissolved at the broken spots, so that these ions function to suppress the corrosion of the underlying metal layer. By these corrosion-preventing functions of the chromate coating layer, the corrosion resistance of the R-TM-B permanent magnet member is improved.

When the adhesion properties of the chromate-coated R-TM-B permanent magnet body are to be improved, it is treated with an alkali solution. For this purpose, the chromate-coated R-TM-B permanent magnet body is immersed in an alkali solution to remove a thin organic film which is likely to be formed thereon. The alkalis which may be used are preferably hydroxides of alkali metals such as sodium, potassium, etc., which are deliquescent compounds. To achieve sufficient detergency, the alkali solution preferably has a concentration of 3% by weight or more, particularly 4–10% by weight. Also, the alkali solution is preferably at a temperature of 20°–80° C., and the immersion time is preferably 1–10 minutes.

After the completion of the alkali immersion treatment, the R-TM-B permanent magnet member is dried. The drying temperature is preferably 20°–120° C. Since excess heating deteriorates the corrosion resistance of the chromate treatment, the drying temperature should not exceed 120° C.

Apart from the above treatment, the R-TM-B permanent magnet members can be provided with excellent corrosion resistance by applying two metal layers made of different metal components. Specifically, a lower metal plating layer selected from Ni, Ni-S, Ni-P, Cu, Cr and Sn, and an upper metal plating layer selected from Ni, Ni-S, Ni-P, Cr, Sn and Zn, which are different from each other, are formed.

When a lower plating layer made of a more noble metal and an upper plating layer made of a less noble metal are formed on a substrate surface, the upper plating layer predominantly is dissolved because of the relation between the lower and upper metal plating layers in natural potential, so that corrosion proceeds from the upper plating layer. That is, the upper metal plating layer exhibits an anodic effect, while the lower metal plating layer is cathodically protected from corrosion. The substrate is also protected from corrosion. By this corrosion-preventing function, the corrosion resistance of the R-TM-B permanent magnet member is improved.

In the above corrosion-preventing function, it is important that the upper metal plating layer is less noble by 100 mV or more than the lower metal plating layer with respect to a natural potential in a 5-weight %-NaCl aqueous solution. Unless the upper metal plating layer is less noble by 100 mV or more than the lower metal plating layer with respect to a natural potential, sufficient corrosion-preventing effect cannot be obtained by a combination of the lower and upper metal plating layers.

Each metal plating layer is formed on the R-TM-B permanent magnet body by an electroplating method, an electroless plating method, a deposition method, etc., depending upon the application of the R-TM-B permanent magnet member. The thickness of each metal plating layer is preferably 5–20 μm.

Incidentally, the treatment with the above alkali solution may be carried out after the formation of the two metal plating layers.

The present invention will be described in further detail by ways of the following Examples.

EXAMPLES 1 AND 2, COMPARATIVE EXAMPLES 1-3

An alloy having a composition of $Nd(Fe_{0.7}Co_{0.2}B_{0.07}Ga_{0.03})_{6.5}$ was prepared by an arc melting, and the resulting ingot was crushed by a stamp mill and a disc mill.

Thereafter, pulverization was conducted in a jet mill by using an $N_2$ gas as a pulverization medium, to obtain fine powder of the R-TM-B permanent magnet having an average diameter of 3.5 μm (FSSS).

The fine powder was molded while applying a magnetic field of 15 kOe in perpendicular to the compression direction at a pressure of 2 ton/cm$^2$. The resulting green body was sintered at 1090° C. for 2 hours in vacuum. The sintered body was cut to a size of 25 mm×25 mm×10 mm, and then heated at 900° C. at 2 hours in an argon atmosphere. It was then rapidly quenched, and kept at 600° C. for 1 hour in an argon atmosphere.

With respect to each of the resulting samples, a first etching by 5 volume % of nitric acid and then a second etching by a mixed acid of 10 volume % of hydrogen peroxide and 25 volume % of acetic acid were conducted. Thereafter, various surface treatments were conducted under the conditions shown in Table 1.

The nickel plating layers of samples (Examples 1 and 2, Comparative Examples 1 and 3) had a thickness of 10 μm, and a sample (Comparative Example 2) had a lower layer having a thickness of 5 μm and an upper layer having a thickness of 5 μm..

With respect to each sample shown in Table 1, a corrosion test (80° C., 90% RH, 500 hours) and a salt spray test (35° C., 5% NaCl, 100 hours) were conducted. The results are shown in Table 2.

TABLE 1

| No. | Surface Treatment | | | | |
|---|---|---|---|---|---|
| Example 1 | Plating with Bright Watts Bath | →* | Immersion in Solution of 10 g/l of $CrO_3$ at 50° C. for 5 Minutes | →* | Drying at 100° C. for 5 Minutes |
| Example 2 | Plating with Bright Watts Bath | →* | Inmmersion in Solution of 15 g/l of $Na_2Cr_2O_7.2H_2O$ at 50° C. for 5 Minutes | →* | Drying at 100° C. for 5 Minutes |
| Comparative Example 1 | Plating with Bright Watts Bath | →* | Drying at 100° C. for 5 Minutes | | |
| Comparative Example 2 | Plating with Dull Watts Bath | →* | Plating with Bright Watts Bath | →* | Drying at 100° C. for 5 Minutes |
| Comparative Example 3 | Plating with Bright Watts Bath | →* | Immersion in Solution of 10 g/l of $CrO_3$, and 5 g/l of $H_2SO_4$ at 50° C. for 5 Minutes | →* | Drying at 100° C. for 5 Minutes |

Note*: Washing with water.

TABLE 2

| No. | Corrosion Test(1) (80° C. 90% RH) | Salt Spray Test(2) (35° C. 5% NaCl) |
|---|---|---|
| Example 1 | No change after 500 Hours | 80 Hours |
| Example 2 | No change after 500 Hours | 80 Hours |
| Comparative Example 1 | Stain was generated after 100 hours of wetting with water, and spot rust was generated locally after 300 hours. | 30 Hours |
| Comparative Example 2 | Stain was gernerated after 100 hours of wetting with water, and spot rust was generated locally after 500 hours. | 50 Hours |
| Comparative Example 3 | Stain was generated after 300 hours of wetting with water, and spot rust was generated locally after 500 hours. | 50 Hours |

Note:
(1)Corrosion resistance: Evaluated by the change of surface appearance.
(2)Salt spray test result is expressed by the time period after which rust was generated.

It is clear from Table 2 that the R-TM-B permanent magnet members of the present invention show extremely improved corrosion resistance than the conventional ones.

EXAMPLE 3

An alloy having a composition of $Nd(Fe_{0.7}Co_{0.2}B_{0.07}Ga_{0.03})_{6.5}$ was prepared by an arc melting, and the resulting ingot was crushed by a stamp mill and a disc mill.

Thereafter, pulverization was conducted in a jet mill by using an $N_2$ gas as a pulverization medium, to obtain fine powder of the R-TM-B permanent magnet having an average diameter of 3.5 μm (FSSS).

The fine powder was molded while applying a magnetic field of 15 kOe in perpendicular to the compression direction at a pressure of 2 ton/cm$^2$. The resulting green body was sintered at 1090° C. for 2 hours in vacuum. The sintered body was cut to a size of 18 mm×10 mm×6 mm, and then heated at 900° C. at 2 hours in an argon atmosphere. It was then rapidly quenched, and kept at 600° C. for 1 hour in an argon atmosphere.

With respect to the resulting sample, a first etching by 5 volume % of nitric acid and then a second etching by a mixed acid of 10 volume % of hydrogen peroxide and 25 volume % of acetic acid were conducted. Thereafter, various surface treatments were conducted under the conditions shown in Table 3.

The sample was subjected to a plating treatment in a bright Watts bath, and then washed with water. The composition of the bright Watts bath was as follows:

$NiSO_4$: 270 g/l
$NiCl_2$: 45 g/l
$H_3BO_3$: 30 g/l

It was then immersed in an aqueous solution of 10 g/l of $CrO_3$ at 50° C. for 5 minutes. Subsequently, it was washed with water, immersed in an aqueous solution of 50 g/l of NaOH at 20° C. for 1 minute, and then dried at 100° C. for 5 minutes.

EXAMPLE 4

The sample prepared in the same manner as in Example 3 was subjected to a plating treatment in a bright Watts bath having the same composition as in Example 3, washed with water and then immersed in an aqueous solution of 10 g/l of $CrO_3$ at 50° C. for 5 minutes. It was then washed with water, immersed in an aqueous solution of 50 g/l of KOH at 20° C. for 1 minute, and then dried at 100° C. for 5 minutes.

EXAMPLE 5

The sample prepared in the same manner as in Example 3 was subjected to a plating treatment in a bright Watts bath having the same composition as in Example 3, washed with water, and then immersed in an aqueous solution of 15 g/l of $Na_2Cr_2O_7.2H_2O$ at 50° C. for 5 minutes. It was then washed with water, immersed in an aqueous solution of 50 g/l of NaOH at 20° C. for 1 minute, and then dried at 100° C. for 5 minutes.

Incidentally, the nickel plating layers of all samples (Examples 3-5) had a thickness of 10 μm.

With respect to each sample, a corrosion test (80° C., 90% RH, 500 hours) and an adhesion test according to ASTM D 1002-64 (shear strength test) were conducted.

The corrosion resistance was evaluated on a sample placed in a constant-temperature bath at 80° C., 90% RH for 500 hours. As a result, no change was observed on any samples of Example Nos. 3-5.

In the adhesion test, an acrylic adhesive was used, and curing conditions were room temperature and 24 hours. A substrate to be bonded to each sample was a steel plate (ASTM D 1002), and a bonding length was 12.5 mm. The measurement was conducted at a peeling speed of 5 mm/min. The results are shown in Table 3.

TABLE 3

| Example No. | Adhesion Strength (kg/cm$^2$)(1) |
|---|---|
| 3 | 200 |
| 4 | 200 |
| 5 | 200 |

Note:
(1)Measured according to ASTM D 1002-64.

It is clear from Table 3 that the R-TM-B permanent magnet members subjected to the alkali immersion treatment according to the present invention show extremely improved adhesion properties than the conventional ones, while maintaining good corrosion resistance.

EXAMPLES 6-8, COMPARATIVE EXAMPLES 4-6

An alloy having a composition of $Nd(Fe_{0.7}Co_{0.2}B_{0.07}Ga_{0.03})_{6.5}$ was prepared by an arc melting, and the resulting ingot was crushed by a stamp mill and a disc mill.

Thereafter, pulverization was conducted in a jet mill by using an $N_2$ gas as a pulverization medium, to obtain fine powder of the R-TM-B permanent magnet having an average diameter of 3.5 μm (FSSS).

The fine powder was molded while applying a magnetic field of 15 kOe in perpendicular to the compression direction at a pressure of 2 ton/cm$^2$. The resulting green body was sintered at 1090° C. for 2 hours in vacuum. The sintered body was cut to a size of 18 mm×10 mm×6 mm, and then heated at 900° C. at 2 hours in an argon atmosphere. It was then rapidly quenched, and kept at 600° C. for 1 hour in an argon atmosphere.

Each of the resulting samples was coated with metal plating layers under the conditions as shown in Table 4 to provide a sample. In the column of "coating method," "A" denotes electroplating, and "B" denotes electroless plating.

The composition of each metal plating bath used was as follows:

| Metal Plating | Metal Plating Bath Composition (weight %) | |
|---|---|---|
| Ni—S | $NiSO_4$: | 270 g/l |
| | $NiCl_2$: | 45 g/l |
| | $H_3BO_3$: | 30 g/l |
| | Brightener: | 10 ml/l |
| Ni—P | $NiSO_4$: | 270 g/l |
| | $NiCl_2$: | 45 g/l |
| | $H_3BO_3$: | 30 g/l |
| | Sodium Hypophosphite: | 30 g/l |
| Ni | $NiSO_4$: | 270 g/l |
| | $NiCl_2$: | 45 g/l |
| | $H_3BO_3$: | 30 g/l |
| Cr | $CrO_3$: | 250 g/l |
| | $H_2SO_4$: | 3 g/l |
| Cu | $CuSO_4$: | 14 g/l |
| | Rochelle salt: | 45.5 g/l |
| | Formalin: | 53 g/l |
| | Sodium hydroxide: | 10 g/l |
| | Sodium carbonate: | 4.2 g/l |

With respect to each sample shown in Table 4, a corrosion test (80° C., 90% RH, 1000 hours) and a salt spray test (35° C., 5% NaCl, 200 hours) were conducted. The results are shown in Table 5.

TABLE 4

| No. | Number | Types* | Metal Plating Coating Method* | Thickness* (μm) | Natural Potential of UpperLayer Relative to Lower Layer (5-%-NaCl) |
|---|---|---|---|---|---|
| Example 6 | 2 | Ni—S/Cu | A/B | 10/10 | −200 mV |
| Example 7 | 2 | Ni—P/Ni | B/A | 10/10 | −200 mV |
| Example 8 | 2 | Cr/Ni | A/A | 10/10 | −100 mV |
| Comparative Example 4 | 1 | Ni—S | A | 20 | |
| Comparative Example 5 | 2 | Ni/Ni—S | A/A | 10/10 | +100 mV |
| Comparative Example 6 | 2 | Cr/Ni—S | A/A | 10/10 | 0 mV |

Note*: Upper layer/lower layer.

TABLE 5

| No. | Corrosion Test(1) (80° C. 90% RH) | Salt Spray Test(2) (35° C. 5% NaCl) |
|---|---|---|
| Example 6 | No change after 1000 Hours | No change after 200 Hours |
| Example 7 | No change after 1000 Hours | No change after 200 Hours |
| Example 8 | No change after 1000 Hours | No change after 200 Hours |
| Comparative Example 4 | Rust was locally generated after 300 hours, and generated entirely after 600 hours. | 20 Hours |
| Comparative Example 5 | Rust was locally generated after 600 hours, and generated entirely after 700 hours. | |
| Comparative Example 6 | Rust was locally generated after 400 hours, and generated entirely after 600 hours. | 30 Hours |

Note:
(1)Corrosion resistance: Evaluated by the change of surface appearance.
(2)Salt spray test result is expressed by the time period after which rust was generated.

It is clear from Table 5 that the R-TM-B permanent magnet members of the present invention show extremely improved corrosion resistance than the conventional ones.

As described above in detail, the R-TM-B permanent magnet based on an rare earth metal, iron and boron is provided with an extremely improved corrosion resistance by the plating layers according to the present invention. Further, by immersing the chromate-coated R-TM-B permanent magnet members in the alkali solution, the adhesion properties of the R-TM-B permanent magnet members are extremely improved.

What is claimed is:

1. An R-TM-B permanent magnet member having an improved corrosion resistance comprising an R-TM-B permanent magnet body having a composition, by weight, of 5–40% of R, 50–90% of TM and 0.2–8% of B, wherein R represents one or more rare earth metals including Y, TM represents one or more transition metals including at least Fe as a main component, and B represents boron, said R-TM-B permanent magnet body being provided with a nickel plating layer having a thickness of 5–20 μm and then with a chromate coating layer having a thickness of 2–20 Å formed on the nickel plating layer by immersing in a chromate plating bath free from strong acid.

2. The R-TM-B permanent magnet member having an improved corrosion resistance according to claim 1, wherein the chromate plating bath free from strong acid contains $Cr^{+6}$ ion in an amount of 0.01 mol/l or more.

3. The R-TM-B permanent magnet member having an improved corrosion resistance according to claim 2, wherein the chromate plating bath free from strong acid comprises an aqueous solution of $CrO_3$.

4. The R-TM-B permanent magnet member having an improved corrosion resistance according to claim 1, wherein the chromate plating bath free from strong acid contains $Cr^{+6}$ ion in an amount of from 0.05–0.1 mol/l.

5. An R-TM-B permanent magnet member having an improved corrosion resistance and adhesion properties comprising an R-TM-B permanent magnet body having a composition, by weight, of 5–40% of R, 50–90% of TM and 0.2–8% of B, wherein R represents one or more rare earth metals including Y, TM represents one or more transition metals including at least Fe as a main component, and B represents boron, said R-TM-B permanent magnet body being provided with a nickel plating layer having a thickness of 5–20 μm and a chromate coating layer having a thickness of 2–20 Å formed on the nickel plating layer by immersing in a chromate plating bath free from strong acid, and then subjected to an immersion treatment in an alkali solution.

6. The R-TM-B permanent magnet member having an improved corrosion resistance and adhesion properties according to claim 5, wherein the chromate plating bath contains $Cr^{+6}$ ion in an amount of 0.01 mol/l or more.

7. The R-TM-B permanent magnet member having an improved corrosion resistance and adhesion properties according to claim 6, wherein the chromate plating bath comprises an aqueous solution of $CrO_3$.

8. The R-TM-B permanent magnet member having an improved corrosion resistance and adhesion properties according to claim 5, wherein the immersion treatment of said chromate-coated R-TM-B permanent magnet body is conducted in an aqueous solution of sodium hydroxide or potassium hydroxide.

9. The R-TM-B permanent magnet member having an improved corrosion resistance and adhesion properties according to claim 5, wherein the chromate plating bath contains $Cr^{+6}$ ion in an amount of 0.05–0.1 mol/l.

10. An R-TM-B permanent magnet member having an improved corrosion resistance comprising an R-TM-B permanent magnet body having a composition, by weight, of 5–40% of R, 50–90% of TM and 0.2–8% of B, wherein R represents one or more rare earth metals including Y, TM represents one or more transition metals including at least Fe as a main component, and B represents boron, said R-TM-B permanent magnet body being provided with a nickel plating layer having a thickness of 5–20 μm and then with a chromate coating layer having a thickness of 2–20 Å formed on the nickel plating layer by immersing in a chromate plating bath free from strong acid and containing $Cr^{+6}$ ion in an amount of 0.01 mol/l or more at a temperature of 20°–80° C. for 1–10 minutes.

11. An R-TM-B permanent magnet member having an improved corrosion resistance and adhesion properties comprising an R-TM-B permanent magnet body having a composition, by weight, of 5–40% of R, 50–90% of TM and 0.2–8% of B, wherein R represents one or more rare earth metals including Y, TM represents one or more transition metals including at least Fe as a main component, and B represents boron, said R-TM-B permanent magnet body being provided with a nickel plating layer having a thickness of 5–20 μm and a chromate coating layer having a thickness of 2–20 Å formed on the nickel plating layer by immersing in a chromate plating bath, free from strong acid and then subjected to an immersion treatment in an alkali solution containing alkali metal hydroxides in an amount of 3% by weight or more at a temperature of 20°–80° C. for 1–10 minutes.

12. The R-TM-B permanent magnet member having an improved corrosion resistance and adhesion properties according to claim 11, wherein the chromate plating bath contains $Cr^{+6}$ ion in an amount of 0.01 mol/l or more.

* * * * *